United States Patent [19]

Langdon

[11] 4,354,282

[45] Oct. 19, 1982

[54] GARMENT WITH SCORE INDICIA AND ATTACHABLE SCORE RECORDING MARKERS

[75] Inventor: Joel A. Langdon, Elizabethtown, Pa.

[73] Assignees: Joseph F. Monahan, Jr.; Ben B. Ellis, Sr., both of Lancaster; Grace M. Nace, Columbia, all of Pa.

[21] Appl. No.: 242,847

[22] Filed: Mar. 12, 1981

[51] Int. Cl.[3] ..... A41B 1/00

[52] U.S. Cl. ..... 2/115; 273/DIG. 30; 40/586

[58] Field of Search ..... 273/DIG. 30; 2/112, 2/115, 246, DIG. 6; 46/DIG. 1; 40/583

[56] References Cited

U.S. PATENT DOCUMENTS

| | | | |
|---|---|---|---|
| 2,871,485 | 2/1959 | Greco | 2/246 |
| 3,724,101 | 4/1973 | Slezak | 40/586 |
| 4,164,910 | 8/1979 | Feiler | 40/586 |
| 4,253,197 | 3/1981 | Posta | 2/115 |

*Primary Examiner*—Doris L. Troutman
*Attorney, Agent, or Firm*—Harvey B. Jacobson

[57] ABSTRACT

A garment to be worn on a body torso while playing an active sports game. The garment includes a front panel for support from and positioning in overlying relation to the chest area of a person wearing the garment and further includes indicia associated with each distinctive color area with the indicia indicating the score values of successive scores of a predetermined sports game. At least one marker of another distinctive color is provided and selectively registrable over the distinctive color areas. Further, the distinctive color areas and the marker include coacting structure operative to repeatedly removably support the marker from selected distinctive color areas for indicating the last scored game point.

7 Claims, 4 Drawing Figures

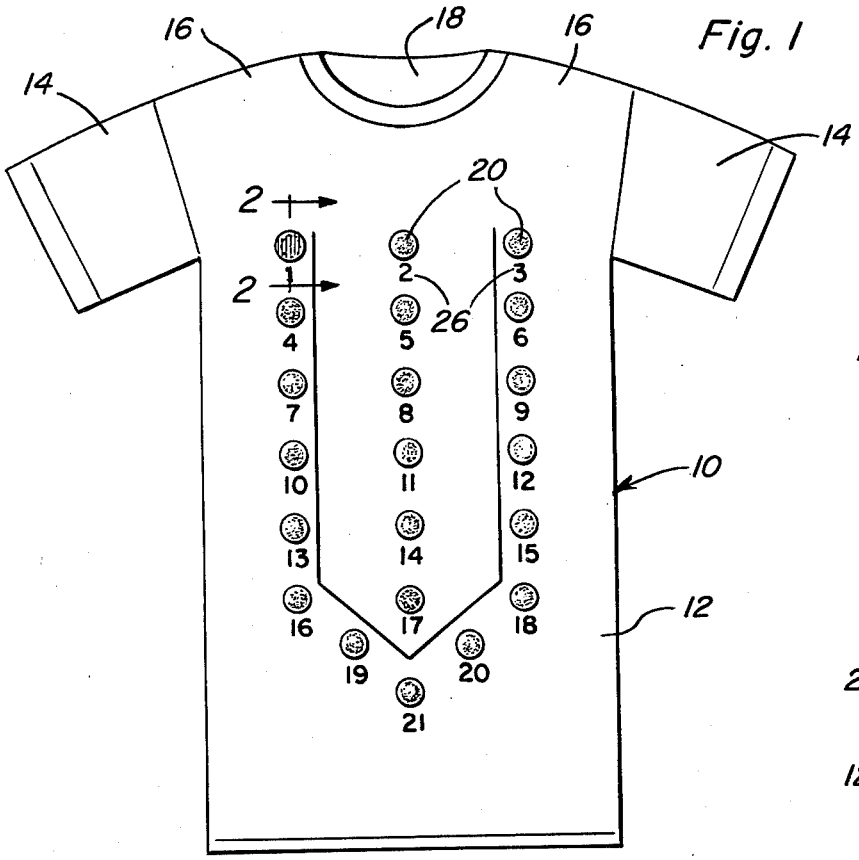
Fig. 1
Fig. 2
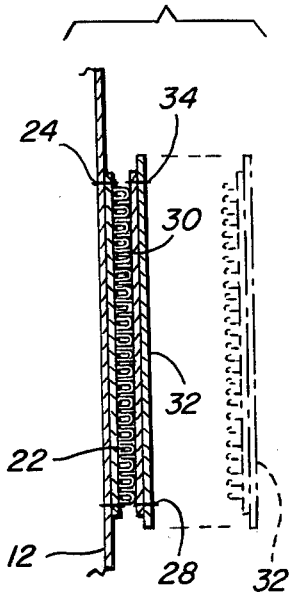
Fig. 3
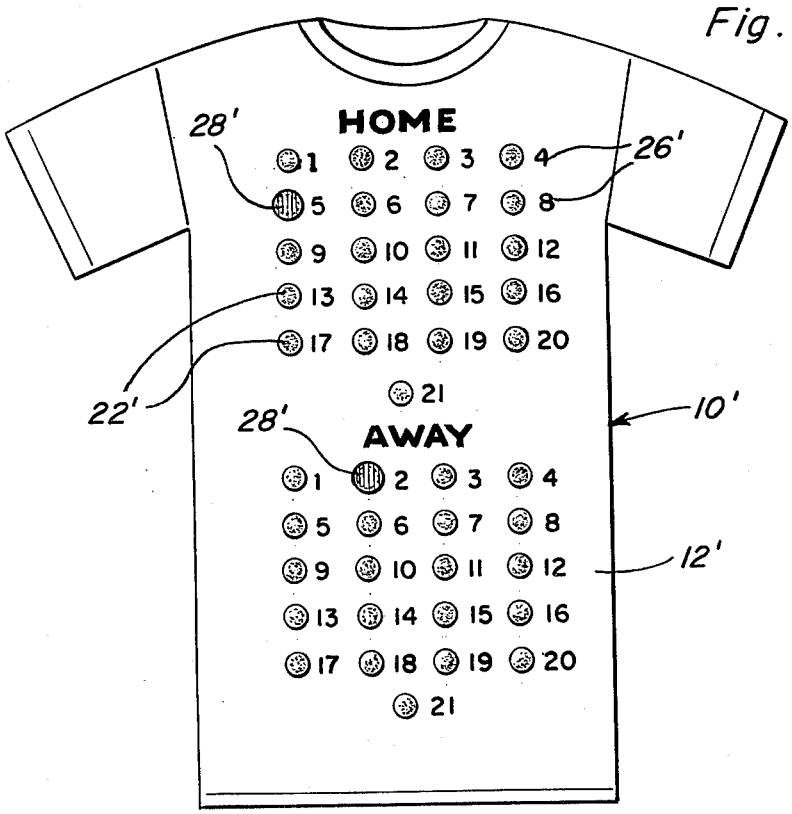
Fig. 4
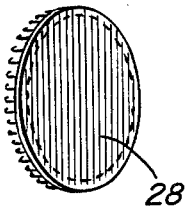

GARMENT WITH SCORE INDICIA AND ATTACHABLE SCORE RECORDING MARKERS

BACKGROUND OF THE INVENTION

Various active sport games are played as competition between two or more persons and in many instances a scorekeeper not playing in the game is not available to maintain accurate scoring of the game.

Accordingly, the two or more players of a game often lose track of the score with differences resulting in their tally of the game score during game play.

While these differences in score tally by different players of a game may sometimes be resolved amicably, in other instances such differences in score tally result in unresolvable disputes, especially when game play is heated between highly competitive players.

Accordingly, a need exists whereby one or more players participating in an active sport game may keep accurate score of the game independent of body movement encumbering devices such as handheld or clothing pocket retained scorekeeping devices.

Although game scoring devices and target areas as well as other devices such as those disclosed in U.S. Pat. Nos. 3,032,345, 3,063,718, 3,479,027 and 3,847,110 heretofore have been provided, these previously known devices are not specifically adapted to allow one or more participants in an active sports game to maintain an accurate record of the game score throughout play of the game and without the game scoring device encumbering body movements.

BRIEF DESCRIPTION OF THE INVENTION

The garment of the instant invention may be worn by one or more players of an active sport game and the garment includes a front panel having distinctive color areas thereon with associated indicia indicating the score values of successive scores of a predetermined sports game. A marker of yet another distinctive color is provided for each set of distinctive color areas and each marker and the corresponding distinctive color areas include coacting structure operative to repeatedly removably support the marker from selected corresponding areas for indicating the last scored game point.

The color areas may include loop "type" material pieces and the marker may include a hook "type" material piece. In this manner, the marker may be readily removably supported from successive score value indicating color areas. Each time a game point is scored, the corresponding marker may be advanced to the next higher score indicating color area.

The main object of this invention is to provide a garment which may be worn by a player of an active sport game and with the garment including structure whereby the prevailing game score may be recorded in a manner readily viewable to all persons playing the game.

Another object of this invention is to provide a garment upon which the prevailing score of a sport game may be maintained in a readily viewable manner and with the garment being only slightly different from a garment conventionally worn when playing that sport game.

A final object of this invention to be specifically enumerated herein is to provide a game score indicating garment in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a front elevational view of a garment constructed in accordance with the present invention;

FIG. 2 is an enlarged fragmentary vertical sectional view taken substantially upon the plane indicated by the section line 2—2 of FIG. 1;

FIG. 3 is a front elevational view of a second form of garment constructed in accordance with the present invention; and FIG. 4 is a perspective view of the removable marker of the garment.

DETAILED DESCRIPTION OF THE INVENTION

Referring now more specifically to the drawings, the numeral 10 generally designates a first form of garment constructed in accordance with the present invention. The garment 10 comprises a short sleeved shirt including a front panel 12 and the garment 10 is, of course, supported from the wearer in the usual manner through the utilization of short arm portions 14 and shoulder portions 16 as well as a back panel 18. The front panel 12 has 21 areas 20 thereon of a color distinctive relative to the color of the front panel and each of the areas 21 comprises a circular disk 22 of loop "type" material sewn to the front panel 12 as at 24. In addition, each of the areas 20 has adjacent indicia 26 closely associated therewith applied to the front panel 12 in any conventional manner, such as by screen printing. The indicia 26 comprise consecutive numerals 1 through 21.

A marker 28 is provided and the marker 28 comprises a disk 30 of hook "type" material and the disk 30 has a second disk 32 sewn thereto as at 34. The disk 32 is of a color distinctive relative to the colors of the disk 22 and the front panel 12. Of course, the marker 28 may be readily removably supported from any of the disks 22 in a manner which is believed to be well known and may be readily disengaged from a disk 22 and applied to the next disk 22.

When playing an active sport game, such as raquetball, one person on each term will wear the garment 10 and be responsible for the score of his or her team. Each time his or her team scores a point the corresponding marker 28 will be detached from the last disk 22 it was attached to and reattached to the next disk 22 having a higher score value indicia 26 associated therewith. In this manner, all of the players of the game may readily determine the score tally at any time during the game.

A second form of garment constructed in accordance with the present invention is referred to in general by the reference numeral 10' and is also in the form of a short sleeved shirt. The garment 10' is substantially identical to the garment 10, except that the front panel 12' thereof includes two sets of 21 disks 22' and having indicia 26' associated therewith. In addition, a pair of markers 28' are provided for use on the garment 10'.

When the garment 10' is utilized, only a single player participating in an active sport game is given the responsibility of maintaining a continuous score tally of both teams throughout team play.

Through utilization of the garments 10 and 10' continuous tally of the score throughout play of an active sport game may be maintained and displayed for ready viewing by all persons playing the game. If it is desired, an extra disk 22 or 22' may be provided on the garment 10 and 10' for use in supporting the marker 28 prior to any score in the game to be played.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A game score indicating garment to be worn on a body torso while playing an active sport game, said garment including a front panel for overlying the chest area of a person wearing said garment, said front panel including predetermined first distinctive color areas thereon with associated indicia indicating the score values of successive scores of a predetermined sport game, and a second distinctive color marker selectively registrable over said color areas, said color areas and said market including coacting means operative to repeatedly removably support said marker on selected areas for indicating the last scored game point.

2. The combination of claim 1 wherein said front panel includes only a single set of distinctive color areas thereon.

3. The combination of claim 1 wherein said front panel includes two sets of distinctive color areas thereon with associated score value indicia operatively associated therewith, and a second marker of a distinctive color with each set of color areas and the associated marker including coacting means for repeated removable support of each marker from any of the corresponding color areas.

4. The combination of claim 1 wherein said successive score value color areas as indicated by the associated indicia are disposed in horizontal transverely extending rows spaced vertically along said front panel with increasingly higher score indicia being disposed in successive lower rows of color areas on said front panel.

5. The combination of claim 4 wherein said front panel includes only a single set of distinctive color areas thereon.

6. The combination of claim 5 wherein said front panel includes two sets of distinctive color areas thereon with associated score value indicia operatively associated therewith, and a second marker of a distinctive color with each set of color areas and the associated marker including coacting means for repeated removable support of each marker from any of the corresponding color areas.

7. The combination of claim 1 wherein said coacting means operative to repeatedly removably support said marker on selected areas comprise releasable engagable loop and hook "fastener" panels carried by said color areas and marker.

* * * * *